US007082777B2

(12) United States Patent
Becke et al.

(10) Patent No.: US 7,082,777 B2
(45) Date of Patent: Aug. 1, 2006

(54) BUILT-IN ELECTRICAL APPLIANCE FOR INSTALLING BEHIND A UNIT-FACING PANEL

(75) Inventors: Christoph Becke, Grosskarolinenfeld (DE); Wolfgang Kaczmarek, Schwindegg (DE); Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/388,021

(22) Filed: Mar. 13, 2003

(65) Prior Publication Data

US 2003/0209018 A1 Nov. 13, 2003

Related U.S. Application Data

(63) Continuation of application No. PCT/EP01/10496, filed on Sep. 11, 2001.

(30) Foreign Application Priority Data

Sep. 13, 2000 (DE) ..... 100 45 236

(51) Int. Cl.
*A47F 3/04* (2006.01)

(52) U.S. Cl. ..... 62/246

(58) Field of Classification Search ..... 49/501, 49/394, 381, 397; 116/303, 313, DIG. 1; 313/2, 642, 204, 265.6; 62/246, 125, 129; 312/204, 265.6, 405

See application file for complete search history.

(56) References Cited

U.S. PATENT DOCUMENTS

| | | | | |
|---|---|---|---|---|
| 35,149 | A * | 5/1862 | Richardson et al. | 106/148.52 |
| 4,814,571 | A * | 3/1989 | Bowen et al. | 219/757 |
| 4,966,004 | A * | 10/1990 | Midlang et al. | 62/77 |
| 5,358,326 | A * | 10/1994 | Cherry et al. | 312/405 |
| 5,487,276 | A * | 1/1996 | Namisniak et al. | 62/125 |
| 5,957,557 | A * | 9/1999 | Langer et al. | 312/223.6 |
| 6,708,506 | B1 * | 3/2004 | Lee | 62/125 |

FOREIGN PATENT DOCUMENTS

| | | | |
|---|---|---|---|
| GB | 2 040 162 | A | 8/1980 |
| JP | 358200940 | A * | 11/1983 |
| JP | 362009126 | A * | 1/1987 |
| JP | 362091729 | A * | 4/1987 |
| JP | 402230026 | A * | 9/1990 |
| JP | 2000354539 | | 12/2000 |
| WO | 97/26486 | | 7/1997 |

* cited by examiner

*Primary Examiner*—Mohammad M. Ali
(74) *Attorney, Agent, or Firm*—John T. Winburn; Russell W. Warnock; Craig J. Loest

(57) ABSTRACT

A built-in electrical appliance for installing behind a unit-facing panel includes a pivotable front flap for fastening the unit-facing panel and a handle that can be fitted on the unit-facing panel for pivoting the front flap. At least one display element for displaying an operating state or an operating variable of the built-in electrical appliance is disposed on the handle.

8 Claims, 3 Drawing Sheets

BUILT-IN ELECTRICAL APPLIANCE FOR INSTALLING BEHIND A UNIT-FACING PANEL

CROSS-REFERENCE TO RELATED APPLICATION

This application is a continuation of copending International Application No. PCT/EP01/10496, filed Sep. 11, 2001, which designated the United States and was not published in English.

BACKGROUND OF THE INVENTION

FIELD OF THE INVENTION

The present invention relates to a built-in electrical appliance for installing behind a unit-facing panel, as is used in fitted kitchens, in particular.

Built-in electrical kitchen appliances substantially include cookers (also referred to as ovens), dishwashers, and refrigerators. For using an oven, it is important for it to be possible to see into the oven without having to open the oven door for such a purpose. In the case of ovens, the users, thus, generally accept that the ovens are installed with a facing panel that originates from the appliance manufacturer and is not matched specifically to the facing of the surrounding units. In the case of refrigerators and dishwashers, however, there is an increasing demand for models that can have their entire front surface concealed by a unit-facing panel and, as such, can be made to blend in and form a uniform unit-facing configuration.

The problem with such fully integrated built-in electrical appliances is that operating and display elements of the built-in electrical appliance can only be fitted on the facing panel with considerable design-related outlay on the part of the appliance or kitchen-unit manufacturer, and possibly with adverse effects on the aesthetic appearance having to be accepted, with the result that a different fitting method is required.

As far as the operating elements of a refrigerator are concerned, it has been common practice for some time now, for example, to disposed the thermostat controller in the interior of such an appliance. This solution can only be used to a limited extent for display elements, because display elements fitted in the interior of the appliance cannot alert a user to a problem with the appliance.

In the case of dishwashers, it is not possible for such elements to be fitted into the interior. Dishwasher manufacturers have, thus, taken to fitting operating elements on the top edge of a front flap of the dishwasher, which bears the unit-facing panel. In such a location, these operating elements are only accessible when the front flap is in an at least partially open state. Any display elements that are, likewise, fitted on the top edge of the front flap cannot be seen by a user when the dishwasher is operating, with the flap closed.

The fully integrated electrical appliances, thus, lack any possible way, when the front flap is closed, of visibly displaying information about their operating state to a user.

SUMMARY OF THE INVENTION

It is accordingly an object of the invention to provide a built-in electrical appliance for installing behind a unit-facing panel that overcomes the hereinafore-mentioned disadvantages of the heretofore-known devices of this general type and in which a visible display of an operating state or of an operating variable is possible without adapting configurations of the built-in electrical appliance and the unit-facing panel, which is used for covering the latter, to one another, with high outlay, for such a purpose.

With the foregoing and other objects in view, in a built-in electrical appliance for installation behind a unit-facing panel, there is provided, in accordance with the invention, a display device including a pivotable front flap to be fastened to the unit-facing panel, a handle to be fitted on the unit-facing panel and, thereby, be fixedly connected to the front flap for pivoting the front flap, and at least one display element for displaying an operating state or an operating variable of the built-in electrical appliance, the at least one display element being disposed on the handle.

A-built-in electrical appliance according to the invention has a pivotable front flap for fastening the unit-facing panel thereon, and a handle that can be fitted on the unit-facing panel and is intended for pivoting the front flap, at least one display element for displaying an operating state or an operating variable of the built-in electrical appliance being disposed on the handle. In the case of such an appliance, the necessary adaptation of the unit-facing panel is restricted to a small number of bores that are necessary in order to fasten the handle and to lead through signals from the front flap of the appliance to the display element on the handle.

With the objects of the invention in view, in a built-in refrigerator for installation behind a unit-facing panel, there is also provided a display device including a pivotable front flap to be fastened to the unit-facing panel, a handle to be fitted on the unit-facing panel and, thereby, be fixedly connected to the front flap for pivoting the front flap, and at least one display element for displaying an operating state or an operating variable of the refrigerator, the at least one display element being disposed on the handle.

If the built-in electrical appliance is a refrigerator, then a display element is, preferably, provided for displaying at least one of the following operating states or variables: measured operating temperature, desired operating temperature, defrosting requirement, and/or malfunctioning, in particular, failure of the refrigerating function.

With the objects of the invention in view, in a built-in dishwasher for installation behind a unit-facing panel, there is also provided a display device including a pivotable front flap to be fastened to the unit-facing panel, a handle to be fitted on the unit-facing panel and, thereby, be fixedly connected to the front flap for pivoting the front flap, and at least one display element for displaying an operating state or an operating variable of the dishwasher, the at least one display element being disposed on the handle.

If the built-in electrical appliance is a dishwasher, then a display element is, preferably, provided for displaying at least one of the following operating states or variables: selected dishwashing program, operating time, in particular, time remaining until the end of the dishwashing program in operation, lack of operating media such as, for example, water, a salt, and/or rinsing agent, blocking of a spray arm or other types of malfunctioning.

In particular for displaying temperatures, operating times, dishwashing programs, or the like, in accordance with another feature of the invention, a display element, preferably, includes an alphabetical and/or numerical display panel. For displaying a selected dishwashing program, it is also possible to use a display panel that can represent pictograms. In order for it to be easy to read, or in order, possibly, to attract the user's attention, the display element is, expediently, luminescent.

In accordance with a further feature of the invention, the at least one display element is luminescent.

In accordance with an added feature of the invention, a first preferred possibility of configuring the display element is to position it in the handle. This means that the display element does not render handling of the handle more difficult. It may also be disposed, however, on a spacer, with the aid of which a gripping element, for example, a bar, is retained in front of the unit-facing panel.

In accordance with an additional feature of the invention, the handle is a bar, the unit-facing panel has a front, spacers are connected to the handle for fitting the handle at the front of the unit-facing panel, and the at least one display element is disposed on one of the spacers.

In the latter case, the spacer, preferably, has a sloping surface, on which the display element is fitted in a clearly visible manner. It is also possible, however, in accordance with a concomitant feature of the invention, for the display element to be pivotable between a sunken position and a clearly visible position.

Other features that are considered as characteristic for the invention are set forth in the appended claims.

Although the invention is illustrated and described herein as embodied in a built-in electrical appliance for installing behind a unit-facing panel, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
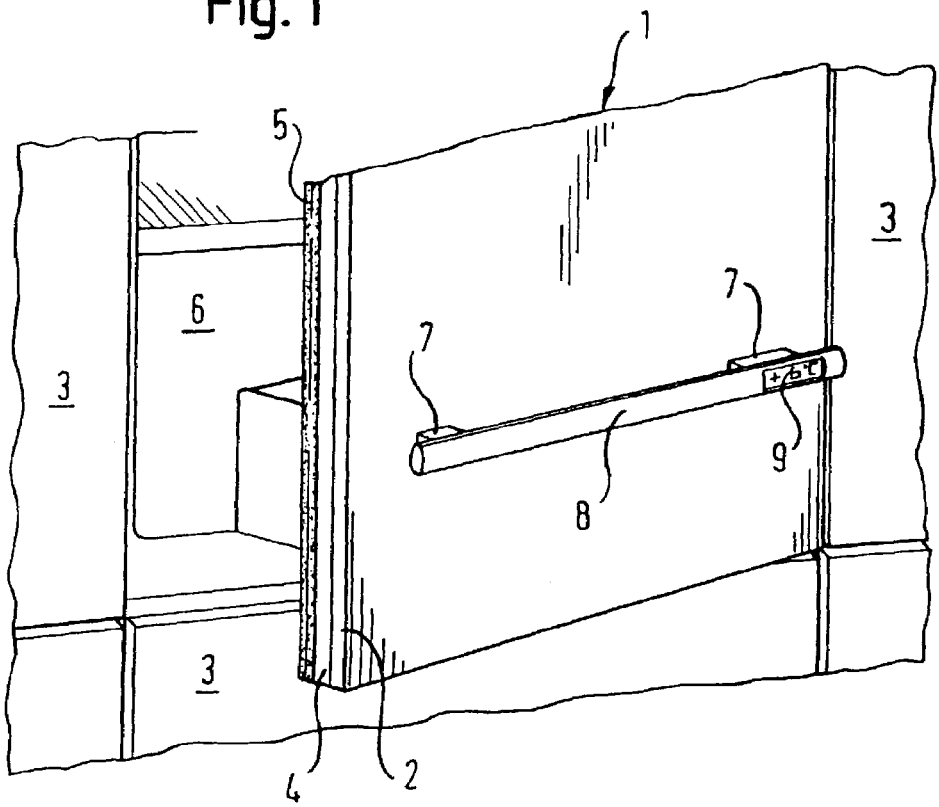
FIG. 1 is a fragmentary, perspective view of a refrigerator as an example built-in electrical appliance according to the invention.

Referring now to the figures of the drawings in detail and first, particularly to FIG. 1 thereof, there is shown, in a fragmentary perspective view, a bottom region of a door 1 of a built-in refrigerator. The outer surface of the door is formed by a unit-facing panel 2, to the right and left of which, and above and beneath which, are located further facing panels 3, which belong to units or other built-in electrical appliances and, together with the facing panel 2 of the door 1, form a unit-facing configuration of uniform decorative appearance.

The door 1 further includes a front flap 4 that can be pivoted about a vertical axis, that contains a heat-insulating filling and, around its border, that bears a magnetic rubber seal 5 that, when the door 1 is closed, seals the interior 6 of the refrigerator in an airtight manner.

Mounted on the visible side of the facing panel 2 is a handle for opening and closing the door, the handle being made up of two spacers 7 and a bar 8. In the region of one of the spacers 7, a display element, in this case an alphanumeric display panel 9 for displaying the temperature measured by a sensor in the interior 6 of the refrigerator, is positioned in a slightly sunken manner.

The display element 9 may be made up, for example, of a multi-segment or matrix configuration of light-emitting diodes or of liquid-crystal display elements.

Alternatively, or as a supplement, it is possible to provide in each case individual display elements, e.g., in the form of differently colored light-emitting diodes, for displaying normal operation or a deviation in the temperature in the interior 6 from the set desired value, e.g., on account of the refrigerating system failing.

Lines for supplying the display panel 9 with energy and display signals are led through that particular spacer 7 in front of which the display panel 9 is fitted and also a bore in the facing panel 2 that is provided behind the spacer 7 and concealed by the same.

A trademark of the refrigerator manufacturer may be provided on the bar 8. As a result, the mark is also visible when the door 1 is closed. This, too, is not possible in the case of conventional fully integrated built-in appliances.

For the facing panel 2, which is usually produced by a kitchen-unit manufacturer, to be adapted to the refrigerator, it is sufficient to provide, for example, in each case one bore in the region of each spacer 7, through which in each case one screw can be guided to fasten the spacers on the facing panel 2, and a further bore for leading through the energy-supply and signal lines of the display panel 9. It is possible to provide on the front flap 4 and the spacer 7 in each case complementary, non-illustrated plug-in connectors, which close when the facing panel 2 is fitted on the front flap 4, and, thus, allow the signal and energy supply to the display panel 9 through the front flap 4.

Figure 2:
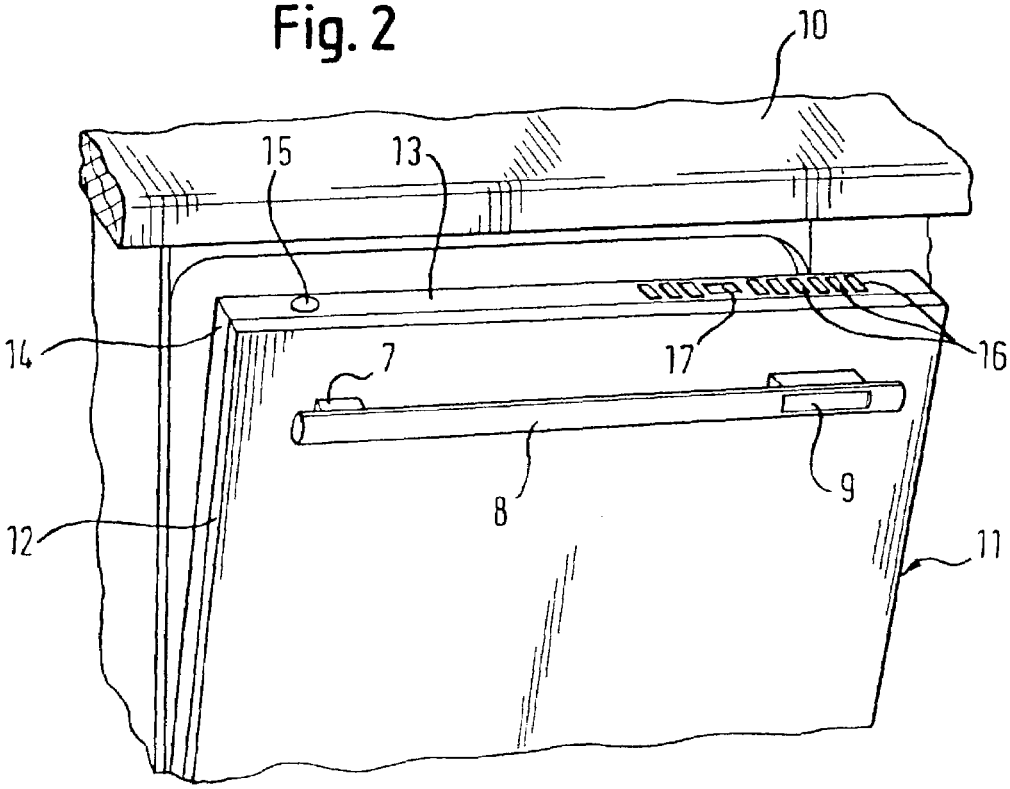
FIG. 2 is a fragmentary, perspective view of a dishwasher as an example of a built-in electrical appliance according to the invention.

FIG. 2 shows a perspective view of the top region of a fully integrated dishwasher that is installed beneath a kitchen worktop 10 and has its door 11 partially open. As in the case of the refrigerator in FIG. 1, the door is made up of a facing panel 12, which is produced by a kitchen-unit manufacturer, is of the same decorative appearance as the facing panels of adjacent units or built-in kitchen appliances, and is anchored on a front flap 14, which is a constituent part of the dishwasher and is mounted such that it can be pivoted about a horizontal axis in its bottom region (which is not illustrated in FIG. 2).

A plurality of operating and display elements, for example, a power switch or on/off switch 15, selector buttons 16 for selecting an operating program of the dishwasher, a display panel 17, etc., are disposed on the top edge 13 of the front flap 14. The display panel 17 can be used for displaying a selected dishwashing program, for displaying the already elapsed time, or, preferably, the time still remaining, of the dishwashing program in operation, or the like. The display panel 17 can also display the lack of operating media, for example, rinsing agent or a salt (i.e., a detergent), which a user can introduce into supply containers of the dishwasher, in an amount that is sufficient for a large number of dishwashing operations, and which the machine can meter automatically.

A handle that is made up of a bar 8, with a second display panel 9 positioned therein, and two spacers 7 is mounted on the unit-facing panel 12 in the same manner as has already been described above in relation to FIG. 1. The display panel 9 of the handle serves for displaying the same information that is also displayed by the display panel 17 on the top edge 13 of the front flap 14. As such, the relevant information is visible to a user even when the door of the dishwasher is closed and the worktop 10 conceals the top edge 13.

In addition, the display panel 9 may also, expediently, be used to indicate other operational problems with the machine that cannot, expediently be, indicated by the display panel 17, for example, an insufficient water supply or blockage of a spray arm rotating in the interior of the machine, e.g., on account of overfilling.

Displaying such fault states on the display panel 17 is not particularly helpful because it is only possible for the states to be detected, or to occur, once the machine has been started up and, once the machine has been started up, a user only gets to see this display panel again when he opens the machine again following the dishwashing program, or if the user interrupts the operation of the machine and opens the door because he/she already suspects a problem. The display on the display panel 9, in contrast, allows the user to detect such defective dishwashing operations at an early stage, to eliminate the fault, and, thus, to save time and operating costs.

Figure 3:
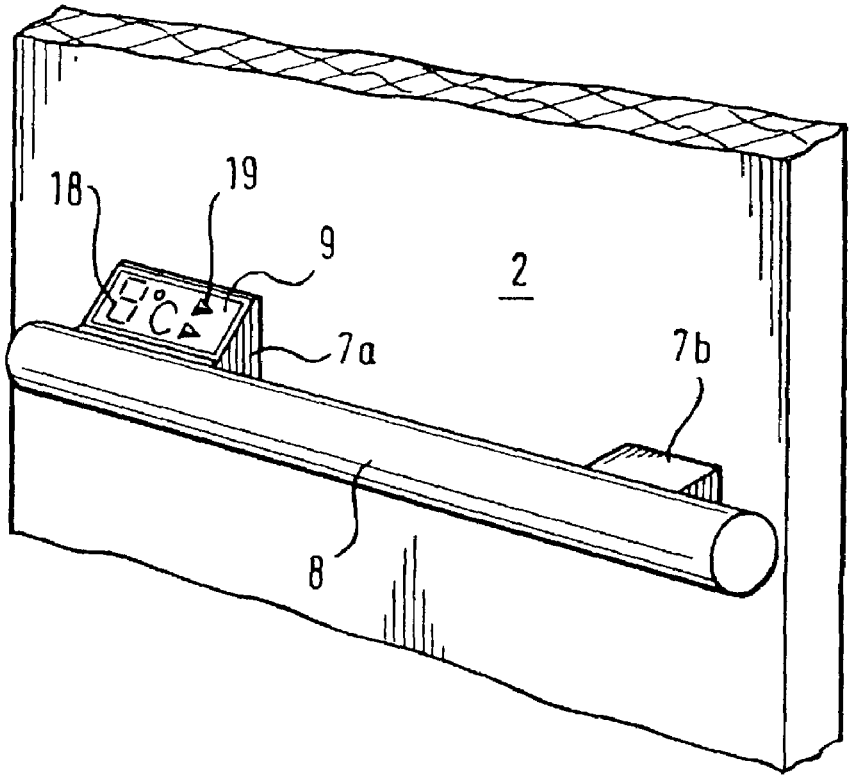
FIG. 3 is a fragmentary, perspective view of a handle of a built-in electrical appliance according to the invention.

FIG. 3 shows a modified configuration of a handle, which can be used both on a refrigerator and on a dishwasher. The handle here is, likewise, made up of a bar 8 and spacers 7*a*, 7*b*, and is mounted on a unit-facing panel 2 of the built-in electrical appliance. The spacer 7*a* has, in its top region, a sloping surface that is filled by the display panel 9. As is indicated in FIG. 3, the display panel may have, for example, an alphanumerical display element 18 for displaying a cooling temperature and one or more display elements 19, in the form of control lights or light-emitting diodes, which display operating states and problems, in the case of a refrigerator, for example, a failure of the refrigerating function or defrosting requirement.

Figure 4:
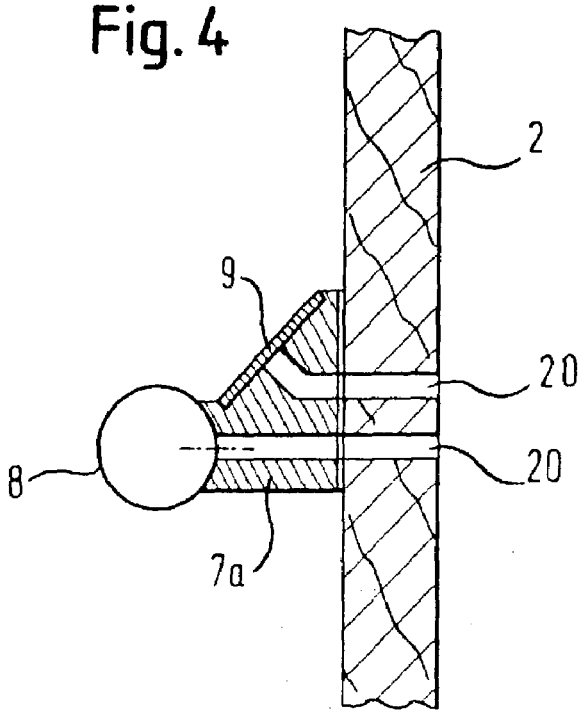
FIG. 4 is a fragmentary, cross-sectional view through the handle of FIG. 3.

FIG. 4 shows a vertical section through the unit-facing panel 2, the bar 8 and the spacer 7*a* from FIG. 3. It is possible to see two bores 20, of which the bottom one is provided for fastening the handle with the aid of a screw, which is introduced into a complementary bore of the spacer 7*a* from the rear side of the unit-facing panel 2, and the top one is provided for leading through non-illustrated supply and signal lines for the display panel 9. In this variant, the height and depth dimensions of the display panel are not predetermined by the dimensions of the handle 8, which are usually restricted from the point of view of aesthetics, and it is possible to display a large quantity of information at the same time, in the case of a combined refrigerator/freezer, for example, the temperatures of different compartments.

Figure 5:
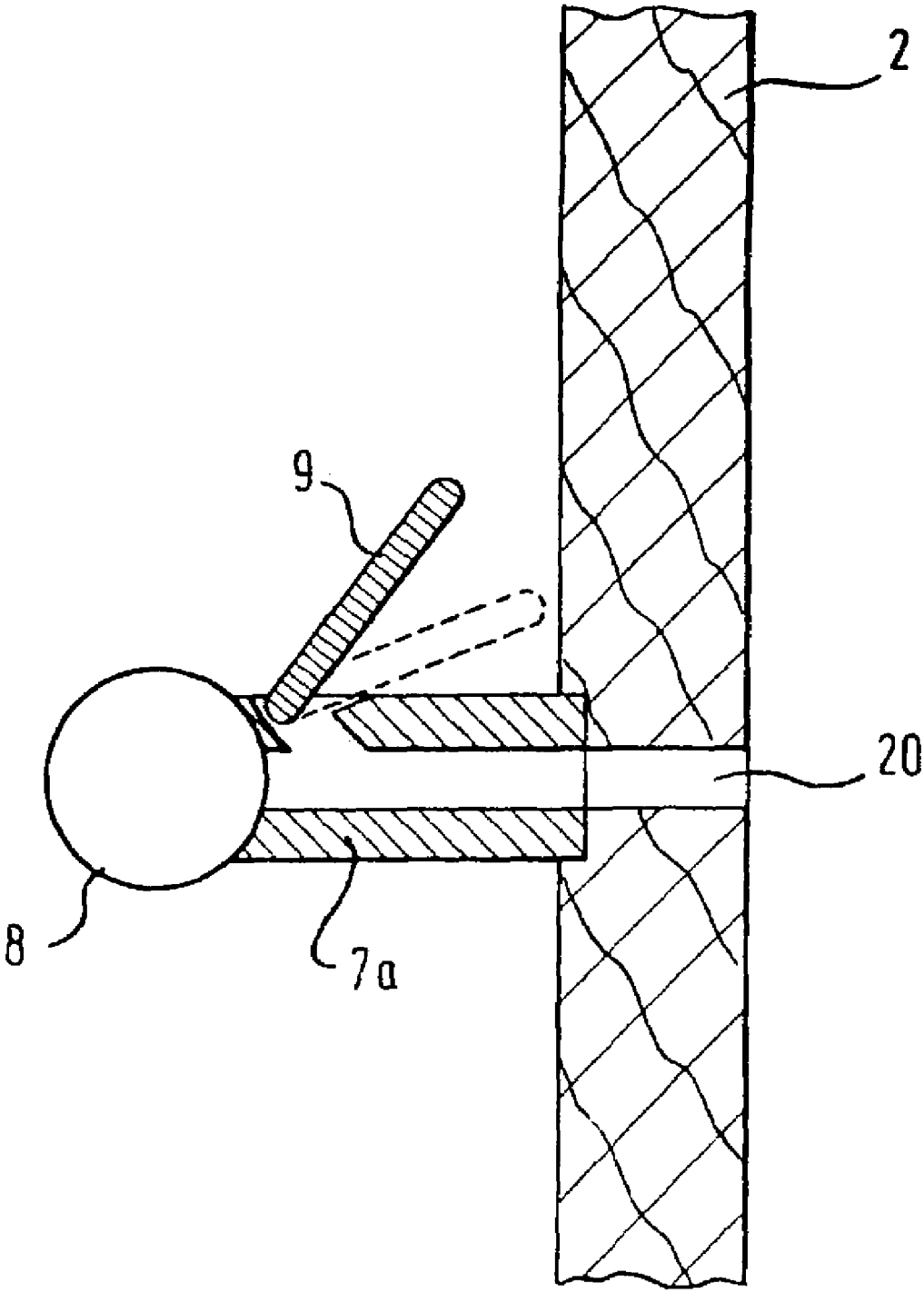
FIG. 5 is a fragmentary, cross-sectional view through an alternative embodiment of the handle of FIG. 4.

FIG. 5 shows a vertical section of a modification of the configuration described with reference to FIGS. 3 and 4. In this embodiment, the display panel 9 is connected in a pivotable manner to the spacer 7*a* and can be moved between an extended position, which is illustrated by solid lines and in which a user at a distance away from the built-in appliance can easily see and read the display panel, and a retracted position, which is illustrated by dashed lines and in which, as is shown in FIG. 5, it butts more or less closely against the spacer 7*a* and is in a sunken position therein. In the second, retracted position, a user who is standing directly in front of the unit-facing panel 2 can easily read the display element 9.

In the case of a built-in electrical appliance that is not in continuous operation, for example, a dishwasher, according to a further modification, the position of the display element 9 is coupled to the operating or non-operating state of the appliance. For example, it may be provided that the display element, when the appliance is switched on, swings out automatically into the extended position, which is illustrated by solid lines, and, when the appliance is switched off, moves back into the retracted position, which is illustrated by dashed lines, or that the appliance is switched off by a user pushing the display element 9 into the retracted position.

Particularly in the case of a dishwasher, it is possible to provide such a coupling that the display element 9 remains in the retracted position for as long as the appliance is non-operational or its front flap is open. As soon as a user has programmed the machine, by selecting the operating program with the aid of the selector buttons 16 fitted on the top edge 13 of the front flap 14, for example, and closes the flap in order to set the machine in operation, the display element 9 swings into the extended position. In the case of such a machine, it is possible to dispense with the display panel 17, which has been described with reference to FIG. 2, because it is replaced, with equal effect, by the display panel 9 when the flap is open. As soon as the flap is closed and the machine is set in operation, a user can easily see the operating state of the machine on the extended display panel 9 without having to stand right in front of the machine for such a purpose.

We claim:

1. In combination with a built-in electrical appliance having a pivotable front flap, a display device comprising:

a unit-facing panel to be attached to the pivotable front flap, the electrical appliance being installed behind said unit-facing panel and said unit-facing panel including a front;

a handle fitted on said unit-facing panel fixedly connected to said front flap for pivoting said front flap, said handle formed as a bar and spacers connected to said handle for fitting said handle at said front of said unit-facing panel; and at least one display element for displaying an operating state or an operating variable of said built-in electrical appliance, said display element disposed on said handle on one of said spacers.

2. The display device according to claim 1, wherein said one spacer has a sloping surface on which is disposed said at least one display element.

3. In combination with a built-in refrigerator having a pivotable front flap, a display device comprising:

a unit-facing panel to be attached to the pivotable front flap, the refrigerator being installed behind said unit-facing panel and said unit-facing panel including a front;

a handle fitted on unit-facing panel fixedly connected to said front flap for pivoting the front flap, said handle formed as a bar and spacers connected to said handle for fitting said handle at said front of said unit-facing panel; and at least one display element for displaying an operating state or an operating variable of the refrigerator, said display element disposed on said handle on one of said spacers.

4. The display device according to claim 3, wherein said one spacer has a sloping surface on which is disposed said at least one display element.

5. The display device according to claim 3, wherein said at least one display element is pivotally disposed on said handle between a sunken position and an extended position.

6. In combination with a built-in electrical appliance having a pivotable front flap, a display device comprising:

a unit-facing panel to be attached to the pivotable front flap, the electrical appliance being installed behind said unit-facing panel and said unit-facing panel including a front;

a handle fitted on said unit-facing panel and, thereby, fixedly connected to the front flap for pivoting the front flap; and at least one display element for displaying an operating state or an operating variable of the built-in electrical appliance, said display element pivotally disposed on said handle between a sunken position and an extended position.

7. In combination with a built-in dishwasher having a pivotable front flap, a display device comprising:

a unit-facing panel to be attached to the pivotable front flap, the dishwasher being installed behind said unit-facing panel;

a handle fitted on said unit-facing panel and, thereby, fixedly connected to the front flap for pivoting the front flap, said handle formed as a bar and spacers connected to said handle for fitting said handle at said front of said unit-facing panel; and at least one display element for displaying an operating state or an operating variable of the dishwasher, said display element disposed on said handle on one of said spacers.

8. The display device according to claim 7, wherein said one spacer has a sloping surface on which is disposed said at least one display element.

* * * * *